United States Patent [19]

Suter

[11] 4,036,353

[45] July 19, 1977

[54] TRANSFER APPARATUS FOR GRIPPING AND HOLDING A SPINNING COP

[75] Inventor: Xaver Suter, Thalwil, Switzerland

[73] Assignee: Maschinenfabrik Schweiter AG, Horgen, Switzerland

[21] Appl. No.: 697,944

[22] Filed: June 21, 1976

[30] Foreign Application Priority Data

July 3, 1975 Switzerland ..... 8684/75

[51] Int. Cl.[2] ..... B65G 47/74

[52] U.S. Cl. ..... 198/486; 198/696; 214/1 BC; 242/35.5 A; 294/116

[58] Field of Search ..... 198/479, 486, 653, 654, 198/694, 695, 696; 214/1 BA, 1 BC; 279/78, 106, 107; 294/115, 116; 242/35.5 R, 35.5 A, 35.6 E

[56] References Cited

U.S. PATENT DOCUMENTS

| | | | |
|---|---|---|---|
| 1,801,456 | 4/1931 | Pryor | 294/116 |
| 2,829,918 | 4/1958 | Stoakes et al. | 294/116 |
| 2,853,336 | 9/1958 | Cruikshank et al. | 294/115 |
| 2,950,805 | 8/1960 | Heimlicher et al. | 198/696 |
| 3,069,035 | 12/1962 | Schwarz et al. | 294/116 |
| 3,094,349 | 6/1963 | Schwalm | 198/654 |
| 3,108,835 | 10/1963 | Rowekamp | 294/116 |
| 3,125,369 | 3/1964 | Copping | 198/694 |
| 3,353,860 | 11/1967 | Meissner | 294/115 |
| 3,608,843 | 9/1971 | Siedlich | 242/35.6 |
| 3,612,254 | 10/1971 | Wideman | 198/694 |
| 3,635,323 | 1/1972 | Helfer et al. | 198/696 |
| 3,757,929 | 9/1973 | Hull et al. | 198/654 |
| 3,850,286 | 11/1974 | Tobin, Jr. | 198/653 |
| 3,863,753 | 2/1975 | Shank, Jr. | 294/115 |
| 3,867,849 | 2/1975 | Onada et al. | 214/1 BC |
| 3,868,010 | 2/1975 | Banyas et al. | 198/696 |
| 3,938,847 | 2/1976 | Peyton | 198/479 |

*Primary Examiner*—Evon C. Blunk
*Assistant Examiner*—Richard K. Thomson
*Attorney, Agent, or Firm*—Flynn & Frishauf

[57] ABSTRACT

A group of grippers, for example three, are located around a centering cone which is arranged to penetrate into and center a spinning cop. The grippers have jaws which, at the inner side, have a gripping engagement zone, for example, formed by a resilient, such as plastic, insert. Upon axial movement of a spinning cop to engage the centering cone, the grippers are cranked upwardly against the circumference of a holding bell, to pivot about the edge of the spinning cop and engage the end of the spinning cop by the engagement surfaces of the grippers, so that portion of the spinning cop is gripped which is normally free of thread, or yarn thereon and damage to the yarn is avoided. The entire assembly is rotatively supported on a swing-arm to swing in one position to pick up the cone, move into another position for handling of yarn on the cop, for example, removing of a foot-lap, and to yet another position for delivery of the cop to the winding machine mechanism.

10 Claims, 6 Drawing Figures

TRANSFER APPARATUS FOR GRIPPING AND HOLDING A SPINNING COP

Cross reference to related patents and applications; U.S. Pat. Nos. 3,380,677, Stapfer; 3,608,843, Siedlich; U.S. Ser. No. 308,875, filed Nov. 8, 1972, Heckel abandoned in favor of U.S. Ser. No. 707,348 filed July 21, 1976 U.S. Ser. No. 692,973, filed June 21, 1976, Suter all assigned to the assignee of the present application.

The present invention relates to apparatus for individually transporting thread or yarn spinning cops in a winding machine, and more particularly, to an arrangement to control operation of grippers to clamp a spinning cop at one end, in which the grippers surround a centering cone penetrating into the open end of the spinning cop.

Winding machines, and particularly automatic cross-winding machines require conveying spinning cops, sequentially, from a supply position to a cop preparation position and then to a loading or charging position of the magazine. The spinning cops are individually gripped by a gripper arrangement, one of which has been illustrate in U.S. Pat. No. 3,608,843, assigned to the assignee of the present invention.

The grippers are subject to high demands: on the one hand, they must reliably grip the spinning cops while, on the other, they must so grip the spinning cops that the windings of yarn or thread thereon are not damaged and that, further, the outer circumference of the winding form is neither deformed or damaged.

It is an object of the present invention to provide an arrangement to grip and convey individual spinning cops which is simple and meets the requirements placed thereon.

SUBJECT MATTER OF THE PRESENT INVENTION

Briefly, clamping jaws are provided which are linked to operating levers to pivot about the pivot point on the operating levers. A spring tends to hold the grippers and the operating levers extended and in non-gripping position, engagement of a spinning cop with a centering cone located between the grippers and pushing upwardly thereagainst moving the grippers inwardly and tipping them into gripping positions. The gripper jaws themselves are formed with engagement zones, preferably defined by a resilient insert, such as a plastic or rubber insert. Tipping of the clamping jaws in the gripping position thus is achieved by relative axial movement between the end of the spinning cop itself and the engagement zones on the grippers.

In accordance with the preferred embodiment, a holding bell is provided in which a spider is axially supported, the operating levers being pivoted to the spider and being movable in or out of the bell, thereby effecting mutually approaching motion and moving the gripper jaws to clamping position. In a preferred form, the operating levers are spring loaded, the spring being arranged to bias the operating levers, and hence, the gripper jaws to open position. The centering cone is connected to a control rod which is also spring loaded, the spring biassing the control rod to have the tendency to project the centering cone from the bell. The control rod is preferably provided with a further spring which has the tendency to pull the control rod into the bell. A cam is provided which acts on the control rod to actually shift the position of the control rod relative to the bell to additionally control movement of the spider, the gripping jaws and the centering cone when the gripper jaws are to release.

The gripper assembly can be constructed in relative simple manner while still having the capability to gently grip a spinning cop and hold it, reliably, but gently and firmly and without damage thereto when receiving a spinning cop, as well as when transporting the same.

The invention will be described by way of example with reference to the accompanying drawings, wherein.

Figure 1:
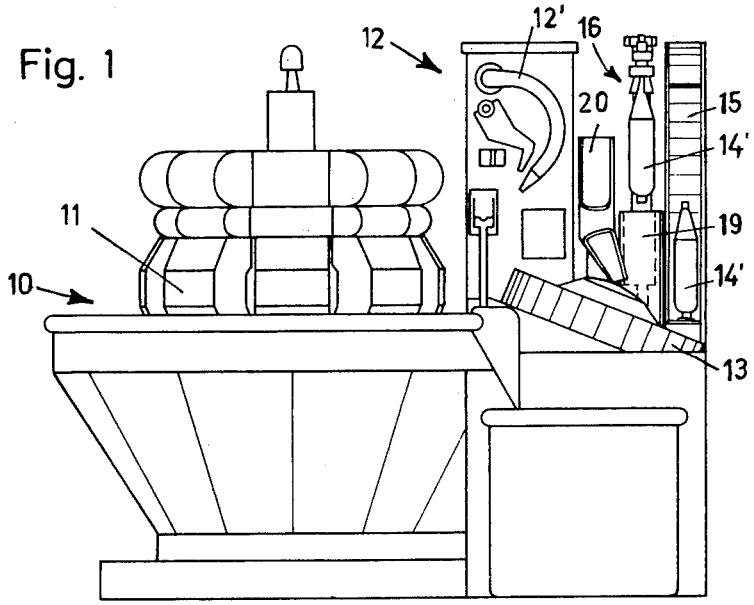
FIG. 1 is a highly schematic side view of an automatic quick traverse winding machine with an apparatus for individual transport of spinning cops.
Figure 2:
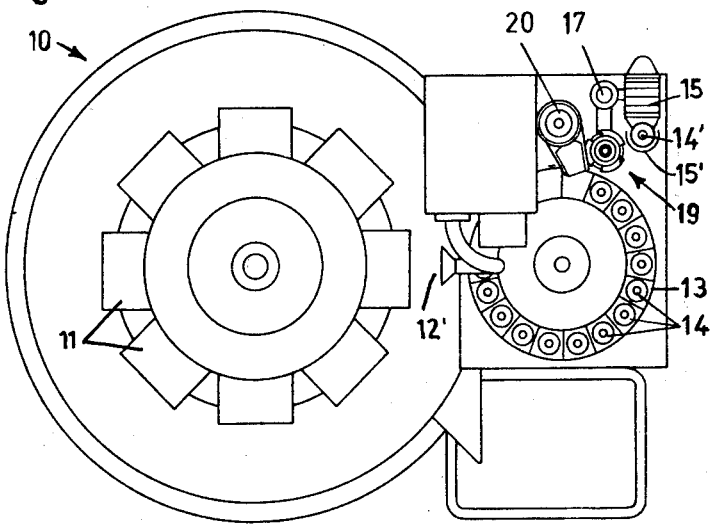
FIG. 2 is a plan view of the machine of FIG. 1.

A high-speed, quick traverse winding machine is illustrated in FIGS. 1 and 2.

A rotatable table 10 has a plurality of winding stations 11 located thereon, as is well known. Means to receive spinning cops (not shown) are located at the lower portion of the winding stations 11. The threads on the spinning cops are to be wound, for example, on cones at each one of the winding positions. Rotation of the table 10 permits automatically exchanging empty spinning cops with full ones; when a spinning cop is empty, a stop motion, or thread threatens detector sense the lack of a thread and rotates the table 10 so that the respective winding position will become associated with an automatic interrupt clearing system 12.

The interrupt clearing system 12, in general, includes an indexing magazine 13 in which spinning cops 14 are placed, already prepared to be placed in winding connection at the respective winding position 11. Suction means 12' are located at the interrupt clearing system 12 to receive the threads to be knotted after an exchange of an empty spinning cop with a full one; a knotter (not shown) which is well known then knots the end of the thread already wound at the winding position with the foot lap of a new spinning cop 14.

A storage bin (not shown) provides spinning cops 14' from which the spinning cops are to be placed in the magazine 13. Spinning cops are removed from the storage bin by a cop conveyor 15 to be then transported to a removal position 15', located adjacent the interruption clearing system 12. The grippers 16, to be explained in detail below, and construction in accordance with the present invention, pick up the cops 14'. The grippers 16 can swing about the shaft 17 to pick up the cop 14', move it to a preparation station 19, and then, after yarn handling therein, move the cop further to a filling station 20. The filling station 20 provides for placing the cop 14' into an empty receptacle of the magazine 13.

The cop preparation station 19 is provided to remove the foot lap from spinning cops; one such construction is shown in U.S. Pat. No. 3,608,843, assigned to the assignee of the present invention; another one is disclosed in the co-pending application Ser. No. 707,348, filed July 21, 1976 (claiming priority of Swiss application No. 8685/75).

Referring now specifically to FIGS. 3–6: the cop grippers 16 have three gripping jaws 21 which are uniformly distributed about the circumference of a spider or star 22. Spider 22 and jaws 21 are linked by operating levers 23. The jaws 21 define at the inside, closed position an approximately conical surface, matching approximately the outer circumference of a spinning cop 14'. The conical surface merges into a cylindrical surface, corresponding approximately to the end portion 14" of the spinning cop form of the spinning cop 14'. The backside of each jaw 21 is formed with a fork 24 (FIG. 3) in which one end of the respective operating lever 23 is pivoted by a pivot pin 25. The other end of each operating lever 23 is pivoted to the spider 22 by pivot pin 26. Springs 27, located at the outer surface of the operating levers 23 and engaging jaws 21 tend to tip the jaws 21 outwardly in open position. These springs may, for example, be suitable tension springs shown only schematically in FIGS. 3–6.

Figure 6:
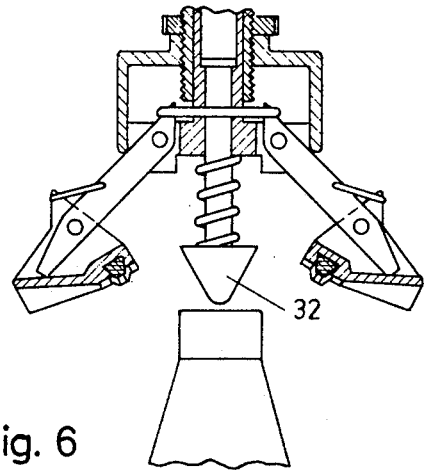

The spider 22 is formed with a hollow sleve-like extension 28 which extends into a bearing bushing 29. The axial extension 28 as well as the spider 22 are axially movable as well as radially rotatable in the bearing bushing 29. Bearing bushing 29 is formed with an outer thread, with which it is threaded into a bell 30. Bell 30 is secured in the bearing bushing by a counter-nut 31'. The bell 30 limits the radial excursion of the operating levers 23 in outward direction, by engagement of the lower edge thereof with the operating rod 23; the extend of outward deflection can be adjusted by relatively adjusting the position of the bell 30 with respect to the bearing bushing 29, that is, by screwing the bell 30 more or less on the thread of bushing 29. A spring, for example, a spring ring 31, engages the inner ends of the operating levers 23; spring 31 tends to bias the operating levers 23 towards open position, that is, it tends to pivot the operating levers 23 radially outwardly; thus, the gripper jaws 21 are, normally held in open position (FIG. 6).

The central bore of the spider 22 and of the axial extension 28 receives a control rod 33, to which, at the lower end, a cop-centering cone 32 is secured. A spring 34, located between spider 22 and the centering cone 32 tends to bias the cone downwardly, that is, to move it away from spider 22 in axial direction (compare FIGS. 5 and 6).

Figure 3:
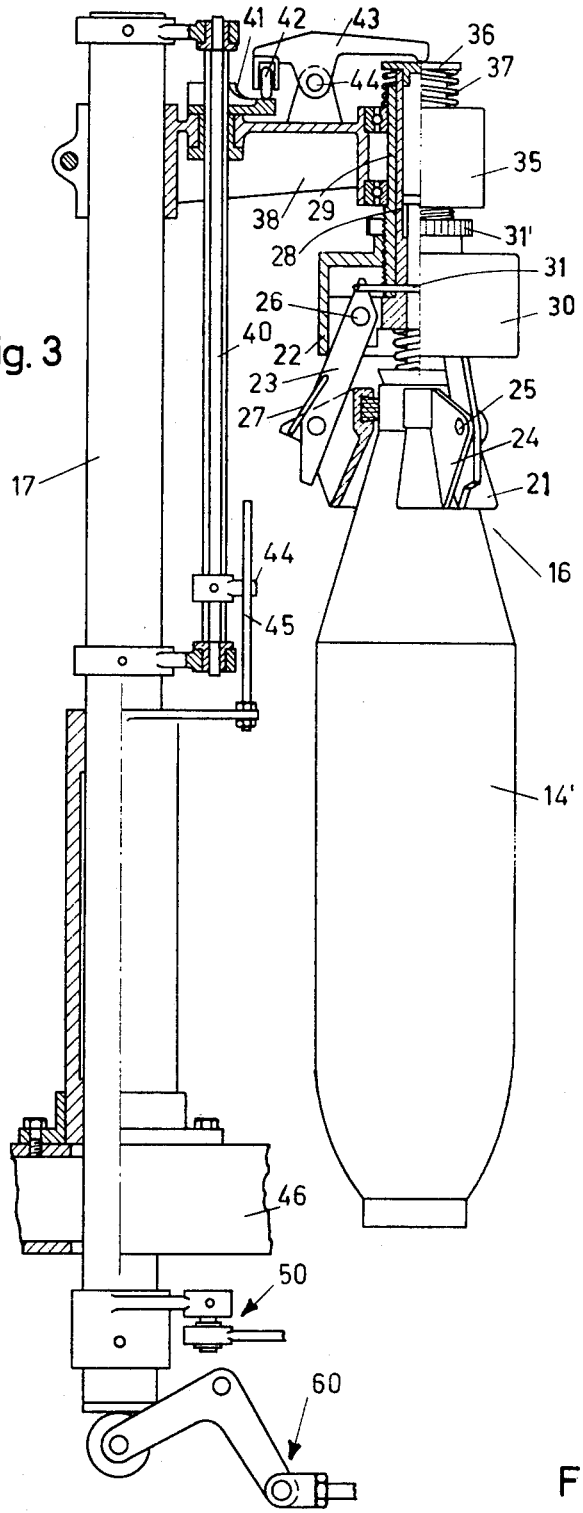
FIG. 3 is a side view, partly in section, to greatly enlarged scale of the apparatus for transporting individual spinning cops in the machine of FIG. 1.

The bushing 29 continues upwardly in axial direction far beyond the upward extent of bell 30, to form a sleeve which is surrounded by a ball bearing 35 (see FIG. 3). The central extension 28 of the spider 22 extends from the free end of the extension sleeve of the bearing bushing 29. The extension 28 terminates in a radial flange 36 (FIG. 3). A spring 37 is interposed between flange 36 and bearing 35, the spring having the tendency to press the spider 22 and hence the jaws 21 axially into the bell 30, that is, to lift the spider upwardly into the bells 30, against the force of the respective resetting springs 31 and 27.

The bearing 35 which supports the bell 30 and the spider-gripper assembly is supported on a cross-arm 38 which, in turn, is rotatable about the axis of shaft 17. The cross-arm 38 is axially movable on the shaft 17 so that it can be adjusted to receive cops of different lengths by axially sliding the arm 38 on shaft 17 and then securing the axial position thereof on shaft 17.

A rotatable camming shaft 40 is located parallel to shaft 17 and supported thereby. A cam disc 41 (FIG. 3) is secured adjacent the upper end of camshaft 40. A cam-follower roller 42 engages the camming disc 41. Cam-follower 42 is located at one end of a double-arm lever 43, which lever can rock about a shaft 44, secured to the cross-arms 38. The other end of the rocking lever 43 engages the ring flange 36 which is secured to the end of the central extension 28 of the spider 22. The arrangement is so made that the rocking lever 43, upon rocking in clockwise direction, tends to press the central extension 28, and hence to spider downwardly against the force of spring 37, that is, in the illustration shown to move the spider 22 in an outward direction with respect to the bell 30.

The grippers 16 are shown in their open position in FIG. 6; this open position is controlled by rotation of the camming disc 41.

To rotate camming disc 41, camshaft 40 is provided with a follower projection 44 which impinges against stops 45 (only one of which is shown) upon rotating together with shaft 17. Stops 45 are secured to the frame 46 of the machine.

Rotary movement of the shaft 17 is effected by a linkage rod 50. This rotary movement carries along, and likewise moves in a circular path the grippers 16. Movement will be in an angular range between the delivery position 15' of the cop conveyor 15 and the cop preparation station 19, and then to the filling station 20 (FIG. 2). Axial movement of the shaft 17 is controlled by linkage 60. The link rods 50 and linkage 60 are moved by controlled elements, not further shown, and forming part of the interrupt clearing system 12. The rods 50, 60, may be operated, for example, from a rotary camming disc.

Figure 4:
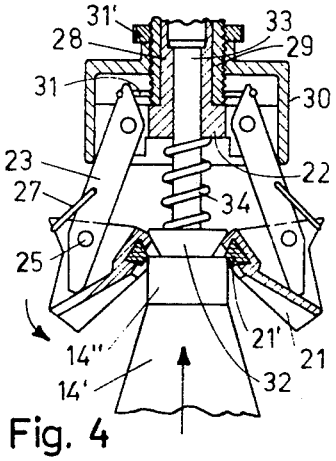
FIGS. 4, 5 and 6 are fragmentary part-sectional views of details of the gripper arrangement in different operating positions.

Operation: Initially, grippers 16 are located above the delivery position 15' of the cop conveyor 15 (FIG. 2). The initial position of the jaws of gripper 16 is in an intermediary, half-open position, as shown in FIG. 4. Upon movement of the cop conveyor 15, to delivery a cop 14' upwardly, the end 14" of the cop form will first reach the region of the cop-entering cone 32 and impinge thereon. Further upward movement of the cop 14 then exerts a force on the centering cone 32 which is pressed counter to spring 34 in the direction of the spider 22, simultaneously centering the cop 14' within the bell, and with respect to the jaws 22. Upon further upward movement, the upper edge of the end 14" of the cop form will impinge against the gripper jaws at the specific engagement zone 21' formed within the cylindrical portion of the outwardly projecting jaws 21. Upon further upward movement of cop 14', jaws 21 will be moved to engage the conical portion of the cop 14'. This movement is particularly apparent from consideration of FIG. 4. FIG. 4 clearly shows the intermediate, or half-open position of the gripper 16. The diameter of the engagement zone 21' of the jaws 21 should be slightly less than the diameter of the end 14" of the cop 14'. The engagement zone is preferably formed by an insert of resilient material, such as plastic or rubber, as shown.

Figure 5:
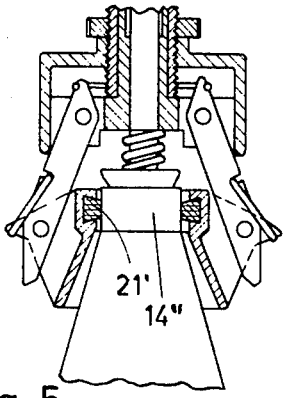

The extent of opening of the grippers is determined by the shape of the camming disc 41 which holds the spider 22 in relative position with respect to the bell 30 under control of the rocking lever 43. Upward movement of the cop 14', effected by the cop conveyor 15 is continued until the cop 14' has reached the position relative to the grippers as illustrated in FIG. 5. This relative movement between the cop 14' and the gripper 16 from the position shown in FIG. 4 to that shown in FIG. 5 causes axial downward sliding of possible threads which happen to have been wound on the end of the cop form. Such possibly present windings are pushed by the inserts 21' of the engagement zones towards the main winding of the cop as the inserts 21' slide along the end portion 41" of the cop form. Thus, such end windings cannot be gripped within the clamping jaws 21 themselves.

When the initial engagement of the clamping jaws 21 to the surface of the cop is terminated, grippers 16 are swung radially by rotation of shaft 17, as controlled by link rod 50. If desired, grippers 16 may also be lifted by synchronous operation of linkage 60. Initiation of movement thus causes the abutment 44 to engage the first stop 45 (FIG. 3) thus partially rotating the camming disc 41 to such an extent that lever 43 is permitted to rock in counter-clockwise direction. Spider 22 is thus pulled inwardly into bell 30 under action of springs 37. The jaws 21 will engage the cop 14' with a pre-determined clamping pressure. This is necessary in order to lift the cop from the cop conveyor 15 and to transport the cop to the preparation station 19 and then to the magazine filling station 20. When the shaft 17 has rotated to a position to place the cop in operative association with the filling station 20, so that the cop can be supplied to the magazine 13, the projection 44 engages a further stop or abutment 45, thus rotating the camming disc 41 to a position in which the lever 43 is rotated clockwise. This places the spider 22, due to rocking of the lever 43 in downward direction as seen in FIG. 6, out of the Bell 30. The jaws 21 will then release the cop 14' so that it can fall freely in a chute of the filling station 20. The entire arrangement is then reset to the initial position in which the camming disc 41 will again control the position of the gripper so that the jaws 21 will have the position of FIG. 4, the location being over the cop delivery position to receive a new cop for engagement by the jaws 21 at the engagement position 21', as aforesaid.

The cops will, therefore, be picked up carefully and gently while being reliably held for transport from the cop receiving point 15' to the cop preparation station 19 and then to the cop supply station 20. It is particularly important that the jaws 21 are first loosely positioned by the relative movement between the cop and the engagement position 21' of the jaws, while being exactly centered in the grippers by the centering cone 32. It is of equal importance that any windings which may, inadvertently, have slipped to the end portion of the cop form are pushed downwardly by the inserts of the engagement positions 21' of the jaws to be moved towards the main winding part on the cop 14', so that such windings will not be pinched in the grippers. As can be clearly seen-compare particularly FIGS. 3 and 4, the necessary clamping pressure applied by the inserts 21' at the cop gripping position is initially directed only to the portion 14'' of the cop form which is free from thread. The remaining surfaces of the clamping jaws 21 are primarily provided in order to maintain and effect proper centering and positioning of the cop in the overall gripper arrangement 16. They do not, for all practical purposes, provide clamping pressure to the conical winding portion of the cop, on which the thread is wound.

Various changes and modifications may be made within the scope of the inventive concept; for example, relative movement between all the gripper jaws and the cop 14' to receive the cop and hold it in the jaws can be effected by lowering of the jaws, or by simultaneous lowering of the jaws and raising of the cop 14'. Various other elements and mechanisms can be devised to trigger the rotary movement of the shaft 17, and hence of the grippers, as well as to trigger the opening and closing movements of the jaws 21 and to control the movement of the jaws 21 between it immediate position (FIG. 4), the clamping position (FIG. 5) and the release or completely open position (FIG. 6). Such control elements may include not only different camming arrangements, but may also be formed by electrol controls acting, selectively, on an element equivalent to the flange 36 in accordance with a timing cycle, or timing program established electrically or mechanically, for example, by control cams cyclically and selectively opening and closing suitable switches, the movement of which is controlled by the interrupt clearing system 12.

I claim:

1. Transport apparatus for gripping and holding spinning cops (14') to transport the cops in automatic winding machines (10, 11) comprising gripper means (16) having a centering cone (32) to center a spinning cop form (14') and a plurality of circularly located gripper jaws (21) arranged to engage the outer surface of an end (14'') of the cop form and to clamp the cop (14') therebetween;

operating levers (23) linked to and supporting the gripper jaws (21);

spring means (27) attached to the respective gripper jaws (21) and to the respective operating levers (23) and tending to hold the jaws in open position but permitting rocking of the jaws (21) to a cop engaging position;

said gripper jaws defining an area forming an engagement zone (21') located on facing surfaces of the gripper jaws (21) and positioned relative to the attachment point of the spring means (27) on the jaws (21) to effect closing movement of the gripper jaws (21) to cop engaging position upon axial pressure directed against said engagement zone (21') by said end (14'') of the cop (14').

2. Apparatus according to claim 1, further comprising a support bell (20), a spider (22) located in the bell and axially movable with respect thereto, the operating levers (23) being pivotably connected to the spider (22), axial movement of the spider (22) in the bell (30) effecting movement of the gripper jaws (21) between closed, cop-engaging position and open, cop-releasing position.

3. Apparatus according to claim 2, further comprising additional spring means (31) connected to and engaging the operating levers (23) and biassing said operating levers, and hence the gripper jaws to open, cop-releasing position.

4. Apparatus according to claim 2, further comprising a spider holding spring (37) acting on the spider and biassing the spider for axial movement into the bell (30).

5. Apparatus according to claim 2, further comprising means (28; 37; 41, 42, 43) controlling axial movement of the spider (22) relative to the bell (30).

6. Apparatus according to claim 5, wherein said spider control means comprises a holding spring (37) biassing the spider, and hence the operating levers and the jaws thereon to be pulled into the bell, so that the operating levers and the jaws (21) thereon will move to closed, cop-engaging position;

and cam means (41, 42, 43) acting counter the bias force of said holding spring (37) and controlling axial movement of the spider, and hence the position of said operating levers (23) and the respective gripper jaws (21) attached thereto.

7. Apparatus according to claim 1, wherein the centering cone (32) is axially slidably movable with respect to the gripper jaws (21), and a centering cone spring (34) is provided, axially biassing the cone to a projected position with respect to the jaws (21), but permitting movement thereof axially inwardly with respect to the jaws upon axial pressure exerted by the end (14') of the cop thereagainst.

8. Apparatus according to claim 1, wherein the gripper jaws (21) are formed with a first cop-engaging surface which, when the gripper jaws are in engagement with the end (14'') of a cop, are located on a circle just slightly smaller than the outer diameter of the end (14'') of the form of the cop (14'), and a second, lower surface which is essentially part conical and diverges outwardly to surround the cop (14').

9. Apparatus according to claim 1, wherein the gripper jaws (21) are formed with resilient inserts located at the engagement zone (21') in sliding engagement with the end (14'') of a cop (14') upon relative axial movement of a cop (14') with respect to the gripper jaws to simultaneously effect closing movement of the cop-engaging position of the gripper jaws, sliding of said inserts along the end (14'') of the form of the cop to push any threads at said end along the form of the cop and prevent pinching of said thread between the jaws.

10. Apparatus according to claim 8, further comprising resilient inserts located at said engagement zones in the first portion of the gripper jaws (21);

and actuating control means (22, 28; 37; 41, 42, 43) connected to said operating levers (23) and controlling the position of said operating levers to an intermediate, half-open position upon engaging a cop (14'), the insert at said engagement zone (21') fitting against the end edge of the end (14'') of the form of the cop upon initial contact and swinging inwardly upon relative axial movement of the cop (14') and said gripper jaws, said inserts sliding axially on the end (14'') of the form of the cop upon continued closing movement of the jaws (21), the second portion of said jaws centering the cop (14') between the gripper jaws (21) and said inserts pushing any threads at the end (14'') on the cop form axially along said cop form, while gripping said end (14'') to hold said end in clamped position when the jaws are fully closed.

* * * * *